United States Patent [19]

Hiraga et al.

[11] 4,303,379

[45] Dec. 1, 1981

[54] SCROLL-TYPE COMPRESSOR WITH REDUCED HOUSING RADIUS

[75] Inventors: Masaharu Hiraga; Kiyoshi Terauchi, both of Isesaki, Japan

[73] Assignee: Sankyo Electric Company Limited, Isesaki, Japan

[21] Appl. No.: 70,929

[22] Filed: Aug. 30, 1979

[30] Foreign Application Priority Data

Sep. 9, 1978 [JP] Japan ..... 53-110215

[51] Int. Cl.[3] ..... F01C 1/00; F04C 18/00

[52] U.S. Cl. ..... 418/55

[58] Field of Search ..... 418/55, 57

[56] References Cited

U.S. PATENT DOCUMENTS

| | | | |
|---|---|---|---|
| 801,182 | 10/1905 | Creux | 418/55 |
| 3,560,119 | 2/1971 | Busch et al. | 418/55 |
| 3,884,599 | 5/1975 | Young et al. | 418/55 |
| 3,924,977 | 12/1975 | McCullough | 418/55 |

*Primary Examiner*—John J. Vrablik

*Attorney, Agent, or Firm*—Hopgood, Calimafde, Kalil, Blaustein & Judlowe

[57] ABSTRACT

A scroll-type compressor unit which includes fixed and orbiting scroll members contained within a cylindrical housing. Each scroll member has an end plate and a spiral element.

In order to reduce the radius of the cylindrical housing, the end plate of the orbiting scroll member is a circular plate having a radius of (a−R/2), and the center of the end plate of the orbiting scroll member is offset from the center of the spiral element affixed thereto, assuming that the radius of the orbital motion of the orbiting scroll member is R, and that the distance between the center and the terminal end of each spiral element is a.

Furthermore, the fixed scroll member is so disposed in the cylindrical housing that the center of the spiral element thereof is offset from the center of the cylindrical housing towards the terminal end of the spiral element thereof by R/2. In this arrangement, the radius of the cylindrical compressor housing is further reduced.

4 Claims, 9 Drawing Figures

SCROLL-TYPE COMPRESSOR WITH REDUCED HOUSING RADIUS

BACKGROUND OF THE INVENTION

This invention relates to fluid displacement apparatus, and in particular, to fluid compressor units of the scroll type.

Scroll type apparatus has been well known in the prior art as disclosed in, for example, U.S. Pat. Nos. 801,182, 3,884,599, 3,924,977, 3,994,633, 3,994,635, and 3,994,636, each of which discloses two scroll members having an end plate and a spiroidal or involute spiral element. These scroll members are maintained angularly and radially offset so that both spiral elements interfit so as to maintain a plurality of line contacts between the spiral curved surfaces to thereby seal off and define at least one fluid pocket. The relative orbital motion of the scroll members shifts the line contact along the spiral curved surfaces and, therefore, the fluid pocket changes in volume. The volume of the fluid pocket increases or decreases dependent on the direction of the orbital motion. Therefore, scroll-type apparatus is applicable to compress, expand or pump fluids.

In comparison with conventional compressors of the piston type, a scroll type compressor has certain advantages, such as a lesser number of parts, continuous compression of fluid and others.

However, in order to increase compressive capacity and compression ratio, it is required that the number of turns of each spiral element be increased. This means that the diameter of the compressor unit is also increased.

RELATED APPLICATION

This application discloses a scroll-type compressor with its diameter reduced to a minimum. In this invention, at certain portions during the orbit of the scroll, the scrolls and end plates do not overlap. In U.S. application Ser. No. 081,392, filed Dec. 3, 1979, a scroll-type compressor is disclosed which has a design having a diameter slightly greater than that of the instant application, but with constant overlaps between the scrolls and end plates to permit a greater volumetric efficiency.

SUMMARY OF THE INVENTION

It is an object of this invention to provide a scroll-type compressor unit wherein the radius of the compressor housing and the weight of the unit are inherently reduced.

It is another object of this invention to provide a scroll-type compressor unit of a cylindrical shape with a relatively small diameter for its intended capacity having smooth operation over a wide range of operating conditions.

It is another object of this invention to provide a scroll-type compressor unit which is simple in construction and production with the above described object being achieved.

In a compressor unit of a scroll type according to this invention, a first scroll member having first circular end plate means and first wrap means is fixedly disposed in a cylindrical compressor housing. A second scroll member having second circular end plate means and second wrap means which is similar to the first wrap means in the number of turns, pitch and thickness is orbitably disposed in the compressor housing with the second wrap means interfitting with the first wrap means to make a plurality of line contacts. The second scroll member is driven by driving means to effect orbital motion of a radius R to shift the line contacts.

The second end plate means is a circular plate having a radius of $(a-R/2)$, where a is a distance from the center of the second wrap means to the outer terminal end thereof. The center of the second end plate means is offset from the center of the second wrap means towards the outer terminal end of the second wrap means by R/2.

The first scroll member is disposed in the cylindrical housing so that the center of the first wrap means is offset from the center of the cylindrical housing towards the outer terminal end of the first wrap means by R/2.

The inner radius of the cylindrical housing can be $(a+R/2)$ at a minimum.

Each of the first and second wrap means can be formed so as to terminate in a gradually reduced section by gradually reducing the increase of the outer radius of the wrap means. In this case, since the distance a is reduced, the radius of the cylindrical housing is further reduced.

Further objects and features of this invention will be understood from the following detailed description of preferred embodiments of the invention with reference to the annexed drawings.

DETAILED DESCRIPTION OF PREFERRED EMBODIMENTS

Before describing specific embodiments of this invention, the principles of the operation of scroll-type compressor will first be described referring to FIGS. 1*a*–1*d* which show a pair of interfitting spiral elements 1 and 2, having similar revolutions, pitches, and thickness.

Figure 1A:
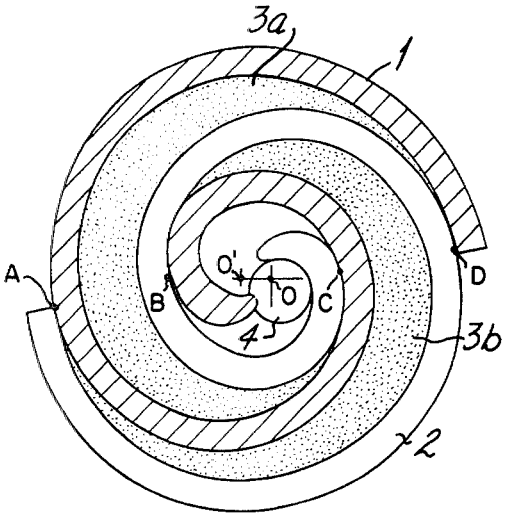
FIGS. 1*a*–1*d* are schematic views illustrating the principle of the operation of a scroll-type compressor.

Referring to FIG. 1*a*, the orbiting spiral element 1 and the fixed spiral element 2 make four line contacts as shown at four points A-D. Fluid pockets 3*a* and 3*b* are defined between line contacts D-C and line contacts A-B, as shown by the dotted regions. Fluid pockets 3*a* and 3*b* are defined not only by the walls of spiral elements 1 and 2 but also by the end plates onto which these spiral elements are affixed. These end plates are omitted in FIGS. 1*a*–1*d*.

Fluid pockets 3*a* and 3*b* move and reduce in volume as orbiting spiral element 1 effects an orbital motion along a circle of a radius R of the distance between centers 0 and 0' of fixed and orbiting spiral elements 2 and 1. This will be understood from FIGS. 1*b*–1*d* which shows the configuration at orbital angular positions $\pi/2$, $\pi$, and $3\pi/2$ of orbiting spiral element 1.

Figure 1B:
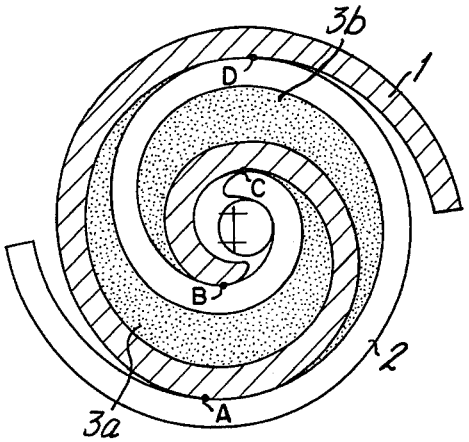
Figure 1C:
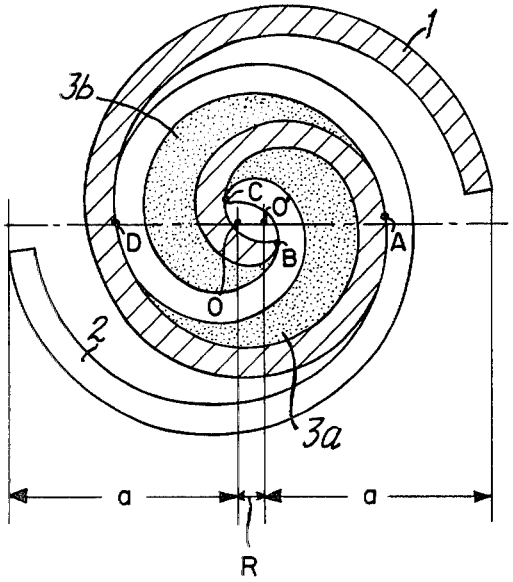
Figure 1D:
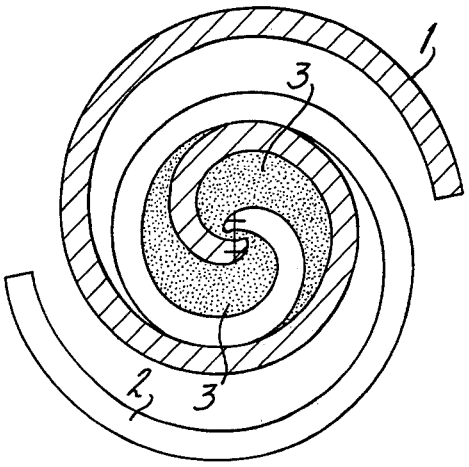

Fluid which is taken into fluid pockets 3*a* and 3*b* by the orbital motion of the orbiting spiral element 1 from the configuration at FIG. 1*d* to the configuration shown in FIG. 1*a*, is compressed by the further orbital motion of orbiting spiral element 1, and is discharged through a discharge port as shown at 4 in FIG. 1*a* which is formed in an end plate (not shown) of the fixed scroll member.

Because the fluid pockets are defined not only by the spiral elements but also by the end plates onto which those spiral elements are affixed as described above, and because the end plate of orbiting scroll member effects the orbital motion of the radius R, the inner radius of the compressor housing must be large enough to permit the end plate of the orbiting scroll member to effect orbital motion.

In known scroll type compressors, assuming that the radius of the orbital motion is R and that the distance from the center of each spiral element to the outer terminal end is a, as shown in FIG. 1*c*, the radius of the end plate of the orbiting scroll member is (a+R) at a minimum, so that the axial end of fixed spiral element 2 along always engages with the end plate of this orbiting scroll member. In the arrangement, the inner radius of the compressor housing must be (a+2R) or more to permit the end plate of radius (a+R) to effect orbital motion of the radius R. The radius of the end plate of the fixed scroll member is selected (a+R) at a minimum.

However, in order to increase compression capacity without sacrificing smoothness of operation, and to increase the internal compression ratio of the gas, it is normally required that the radius of the compressor unit or the number of turns of each spiral element be increased. Where the diameter of the compressor unit is limited by design considerations, the maintenance of as high a capacity as possible within the restricted diameter of the housing is essential.

It is, therefore, a primary object of this invention to provide a scroll-type compressor unit wherein the radius of the compressor housing is reduced.

Figure 2:
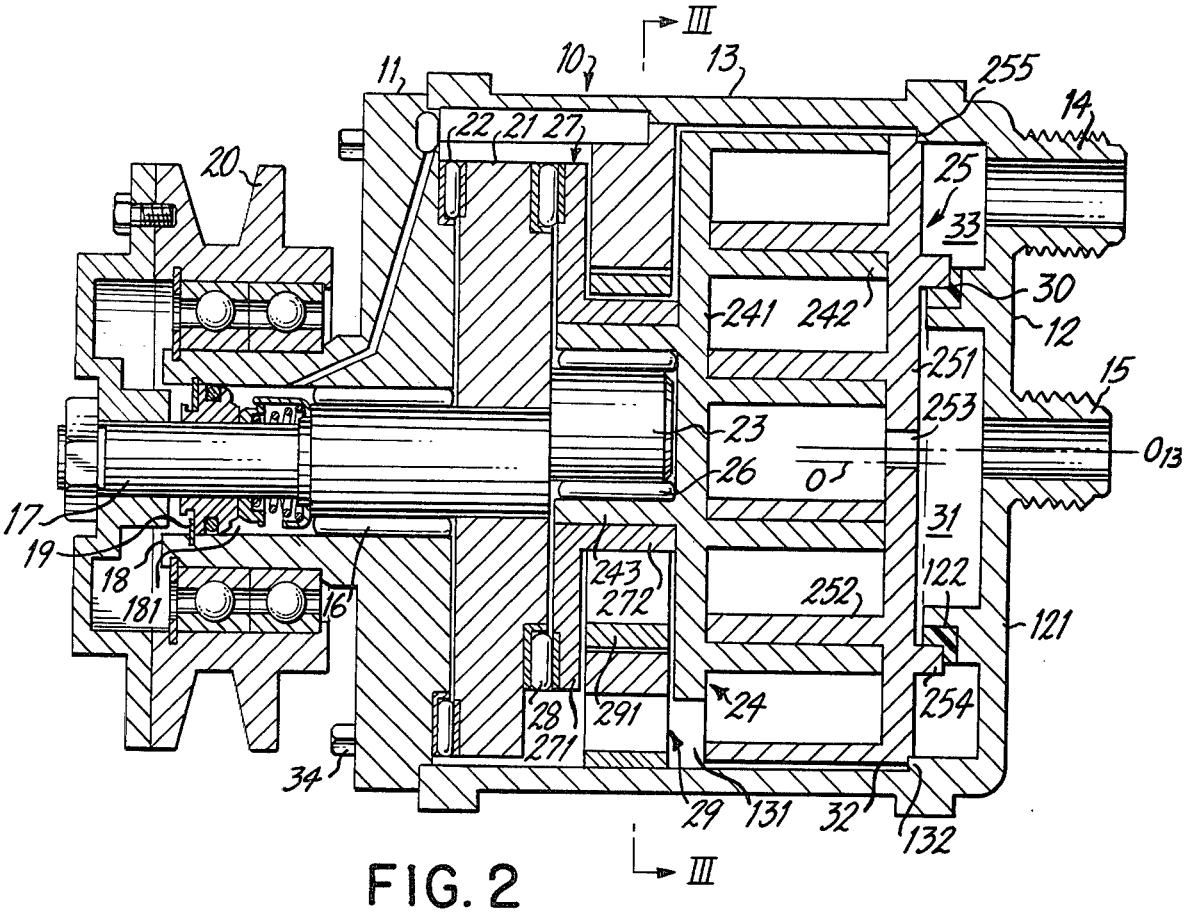
FIG. 2 is a vertical sectional view of a compressor unit of the scroll-type according to an embodiment of this invention.

Referring to FIG. 2, a refrigerant compressor unit 10 of a first embodiment includes a compressor housing comprising a front end plate 11, a rear end plate 12 and a cylindrical body 13 joining the end plates. Rear end plate 12 is shown integrally formed with cylindrical body 13 and is provided with a fluid inlet port 14 and a fluid outlet port 15 formed therewith. A drive shaft 17 is rotatably supported by a radial needle bearing 16 in front end plate 11. Front end plate 11 has a sleeve portion 18 projecting from the front surface thereof and surrounding drive shaft 17 to define a shaft seal cavity 181. Within shaft seal cavity 181, a shaft seal assembly 19 is assembled on drive shaft 17. A pulley 20 is rotatably mounted on sleeve portion 18 and is connected with drive shaft 17 to transmit an external power source (not shown) to drive shaft 17 through belt means (not shown) wound around pulley 20. A disk rotor 21 is fixedly mounted on an inner end of drive shaft 17 and is born on the inner surface of front end plate 11 through a thrust needle bearing 22 which is concentric with drive shaft 17. Disk rotor 21 is provided with a drive pin 23 projecting from the rear surface thereof. Drive pin 23 is radially offset from drive shaft 17 by a predetermined amount.

Reference numerals 24 and 25 represent a pair of interfitting orbiting and fixed scroll members. Orbiting scroll member 24 includes a circular end plate 241 and a wrap means or spiral element 242 affixed onto one end surface of the end plate. End plate 241 is provided with a boss 243 projecting from the other end surface thereof. Drive pin 23 is fitted into boss 243 with a radial needle bearing 26 therebetween, so that orbiting scroll member 24 is rotatably supported on drive pin 23.

A hollow member 27 having a radial flange 271 is non-rotatably fitted onto boss 243 by means of a key and keyway connection. Radial flange 271 is supported on the rear end surface of disk rotor 21 by a thrust needle bearing 28 which is concentrically disposed with drive pin 23. The axial length of hollow member 27 is equal to, or longer than, the axial length of boss 243, so that the thrust load from orbiting scroll member 24 is supported on front end plate 11 through disk rotor 21. Therefore, rotation of drive shaft 17 effects orbital motion of orbiting scroll member 24 together with hollow member 27. Specifically, orbiting scroll member 24 moves along a circle of a radius of the length of the offset between drive shaft 17 and drive pin 23.

Means 29 for preventing orbiting scroll member 24 from rotating during the orbital motion are disposed between end plate 241 of orbiting scroll member 24 and radial flange 271 of hollow member 27.

Figure 3:
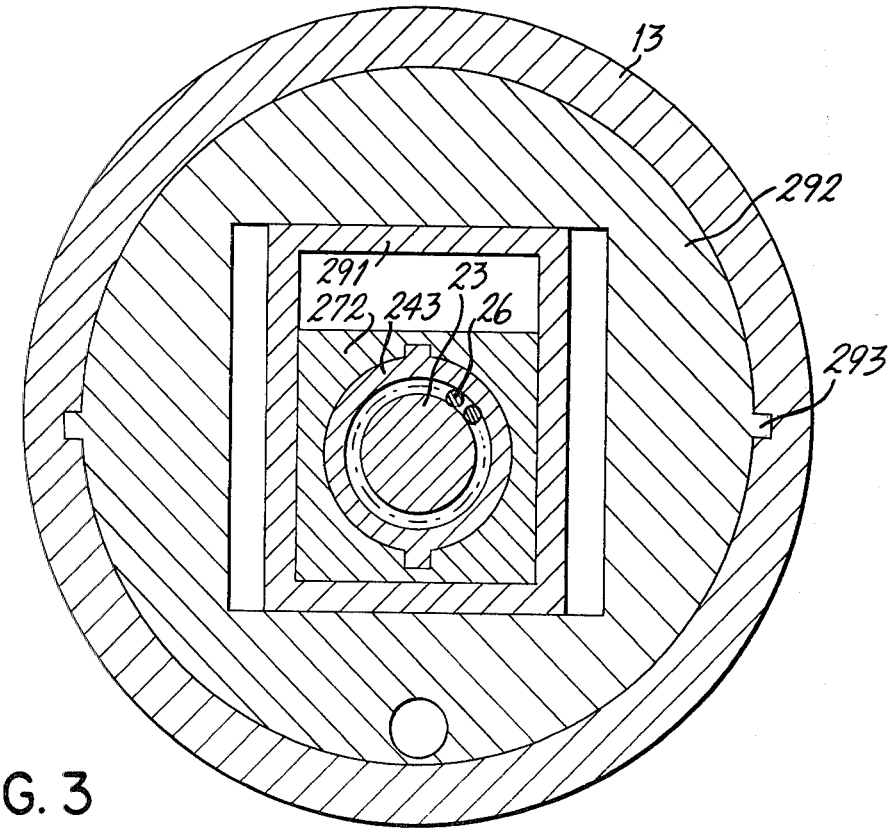
FIG. 3 is a sectional view taken along line III—III in FIG. 2.

Referring to FIG. 3 in addition to FIG. 2, hollow member 27 includes a cylindrical portion 272 having a rectangular outer contour, on which a rectangular slider member 291 is slidable fitted to permit motion in a radial direction. Rectangular slider member 291 has a rectangular opening with one pair of parallel sides equal in length to one pair of parallel sides of the outer rectangle of cylindrical portion 272 and with the other pair of parallel sides longer than the other pair of sides of the rectangular cylindrical portion 272 by at least twice the offset length between drive shaft 27 and drive pin 23. Accordingly, slider member 291 is slidable on hollow member 27 in a radial direction along the longer parallel sides of the rectangular hole. Slider member 291 is also fitted into a ring like member 292 which is non-rotatably fixed to the inner surface of cylindrical body 13 of the compressor housing by a key and keyway connection (shown at 293 in FIG. 3). The central hole of ring like member 292 is a rectangular hole with one pair of parallel sides equal in length to one pair of parallel sides of the outer rectangle of slider member 291 and with the other pair of parallel sides longer than the other parallel sides of the same outer rectangle by at least twice the offset length between drive shaft 17 and drive pin 23, so that slider member 291 may be slidable within ring like member 292 in a radial direction perpendicular to that of the sliding direction of it on hollow member 27.

Accordingly, hollow member 27 is permitted to move in two radial directions perpendicular to one another and, therefore, moves along a circle as a result of movement in the two radial directions, but is prevented from rotation. Therefore, the eccentric movement of drive pin 23 by the rotation of drive shaft 17 effects the orbital motion of orbiting scroll member 24 together with hollow member 27 without rotation.

In another construction of ring like member 292, it has a central hole permitting the hollow member to axially pass therethrough and is formed with a depression in an end surface for receiving and slidably guiding slider member 291. This construction of ring like member 292 permits the member itself to be thin.

Fixed scroll member 25 also includes a circular end plate 251 and a wrap means or spiral element 252 affixed to one end surface of the end plate. End plate 251 is provided with a hole or a discharge port 253 formed at a position corresponding to the center line of the spiral elements, and with an annular projection 254 on the rear end surface around discharge port 253.

Rear end plate 12 is provided with an annular projection 121 on inner surface thereof around the outlet port 15. The outer radius of annular projection 121 which is slightly shorter than the inner radius of annular projection 254. Annular projection 121 is cut away along the outer edge of the projecting end to define an annular recess 122. An annular elastic material, for example, a rubber ring 30 is fitted into annular recess 122 and is compressed between the interfitted annular projections 121 and 254, so that fixed scroll member 25 is elastically supported on annular projection 121 of rear end plate 12. Rubber ring 30 serves as to seal off a chamber 31 defined by annular projections 121 and 254 from the interior space 131 of the compressor housing. Chamber 31 connects between outlet port 15 and the discharge port of fixed scroll member 25.

End plate 251 of fixed scroll member 25 is formed with a plurality of cut away portions 255 at its rear peripheral edge. A plurality of projections 132 are formed on the inner surface of cylindrical body 13 of the compressor housing and are mated into cut away portions 255, so that fixed scroll member 25 is non-rotatably disposed within the compressor housing. Gaps 32 are maintained between the inner wall of the cylindrical body 13 and the peripheral end of fixed scroll member 25, and, therefore, a chamber portion 33 surrounding annular projections 121 and 254 does not form a sealed off chamber within the interior space 131 of the compressor housing. Chamber portion 33 communicates with inlet port 14.

In operation, when drive shaft 17 is rotated by an external power source (not shown) through pulley 20, drive pin 23 moves eccentrically to effect the orbital motion of orbiting scroll member 24. The rotation of orbiting scroll member 24 is prevented by rotation preventing means 29. The orbital motion of orbiting scroll member 24 compresses the fluid introduced in the interior space 131 through inlet port 14, chamber portion 33, and gaps to 32. The compressed gas is discharged from outlet port 15 through discharge port 253 and chamber 31.

In the arrangement as described above, since fixed scroll member 25 is axially urged toward orbiting scroll member 24 by the restoring force of compressed rubber ring 30, sealing between end plate 241 of orbiting scroll member 24 and the axial end of fixed spiral element 252, as well as between end plate 251 of fixed scroll member 25 and the axial end of orbiting spiral element 242 is secured. The sealing is reinforced by the fluid pressure discharged into chamber 31. The axial load for securing seal is supported on disk rotor 21 through orbiting scroll member 24, hollow member 27 having radial flange 271, and thrust bearing 28. The axial load is further supported through disk rotor 21 and thrust bearing 22 on front end plate 11 which is secured onto the front end of cylindrical body 13 of the compressor housing. Therefore, any deflection of the moving parts is prevented during operation of the compressor, so that vibration of the compressor and abnormal wear on the parts may be prevented. Since disk rotor 21 fixedly mounted on drive shaft 17 is supported through thrust bearing 22 on front end plate 11, drive shaft 17 is securely and non-vibratingly supported by the use of a single needle bearing as a radial bearing.

The radial sealing force at each line contact between fixed and orbiting spiral elements 252 and 242 is determined by the radius of the orbital motion of orbiting scroll member 24 or the offset length between drive shaft 17 and drive pin 23, and the pitch and thickness of each of fixed and orbiting spiral elements 252 and 242. In practical use, the distance between drive shaft 17 and drive pin 23 is preferably selected slightly larger than half of the dimensional difference between the pitch of each spiral element and the total dimension thickness of the fixed and orbiting spiral elements. This arrangement is permitted by the fact that fixed scroll member 25 is movably radially supported by compressed rubber ring 30. A sufficient radial seal is established, even during the initial use of the compressor as assembled. The radial seal is completed when the contact surfaces of both spiral elements wear during use to fit one another.

In the arrangement of the compressor as described above, assembly operation of the compressor is simple; annular elastic material 30, fixed and orbiting scroll members 25 and 24, rotation preventing means 29, hollow member 27, bearings 26 and 28, and a pre-assembly of drive pin 23, disk rotor 21, bearings 16 and 22, drive shaft 17 and front end plate 11, are inserted in this order into cylindrical body 13 having rear end plate 12, and the compressor is completed by securing front end plate 11 onto cylindrical body 13 by bolt means 34. In the above described embodiment, end plate 241 of orbiting scroll member 24 is a circular plate of a radius of $(a-R/2)$, and the center of orbiting end plate 241 is offset from the center of the orbiting spiral element 242 towards the terminal end of orbiting spiral element 242 by $R/2$, where a is a distance from a center of each one of spiral elements to the terminal end of the spiral element, and R is the radius of the orbital motion of the orbiting scroll member. This enables a reduction in the radius of the compressor housing.

Figure 4:
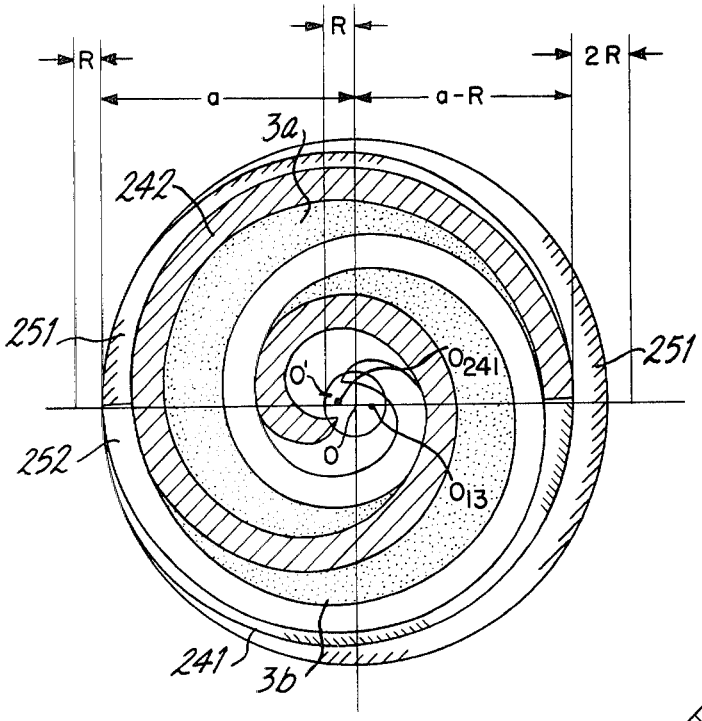
FIG. 4 is a schematic view illustrating the dimensional relationship between the cylindrical compressor housing and the end plate of the orbiting scroll member in the embodiment shown in FIG. 2.

Referring to FIGS. 1*c* and 4, a minimum diameter of a circle which contains interfitting spiral elements 242 and 252 is the distance from the outer terminal end of one of spiral elements to the outer terminal end of the other, and the distance changes from $(2a-R)$ to $(2a+R)$ with the orbital motion of orbiting spiral element 242.

As previously described, the diameter of each end plate is selected $2(a+R)$ or more in conventional scroll-type compressors to insure constant contact between the spiral element of each scroll member and the end plate of the other scroll member.

However, since the end plates of the scroll members define axial opposite ends of the fluid pockets, it is not necessary that the end plates of each of the scroll members always engages with the entire axial end surface of the other one of scroll members, for example, at the positions shown in FIGS. 1*b*–1*d*. All that is required to define fluid pockets is that the end plate cover the entire axial end surface of the scroll member at the state shown in FIG. 1*a* or FIG. 4 where the outer terminal end of each one of scroll members is in contact with the other. Therefore, end plate 241 of orbiting scroll member 24 can be formed as a circular plate having a diameter of $(2a-R)$, or a radius of $(a-R/2)$. Then, the center $0_{241}$ of the end plate is offset from the center $0'$ of orbiting spiral element 242 towards the outer terminal end of the orbiting spiral element by $R/2$.

In the arrangement, when the orbiting scroll member effects orbital motion, the envelope of the cricular end plate of the orbiting scroll member is a circle of radius $(a+R/2)$ with its center spaced apart from the center of the fixed spiral element 252 by R/2 in a direction opposite to the outer terminal end of the fixed spiral element. Therefore, the radius of the compressor housing is $(2a+R)/2=a+R/2$ at a minimum. Then, the center 0 of fixed spiral element 252 is offset by R/2 from center $0_{13}$ of the compressor housing towards the outer terminal end of fixed spiral element 252. The inner radius $(a+R/2)$ is smaller by 3R/2 than that $(a+2R)$ of the conventional scroll-type compressor.

According to this invention, the radius of the compressor housing is reduced by the use of a circular plate having a radius of $(a-R/2)$ for the end plate of the orbiting scroll member, as described above.

Figure 5:
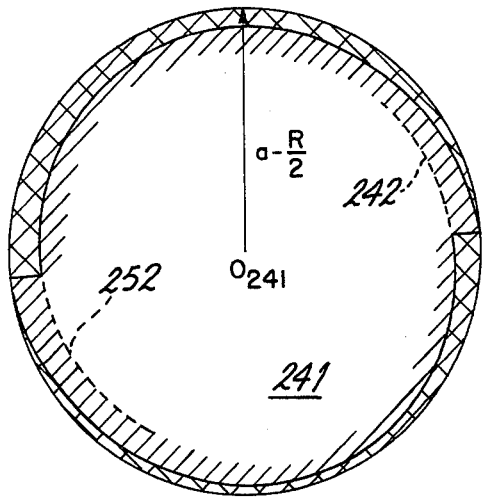
FIG. 5 is an end view of the end plate of the orbiting scroll member according to another embodiment of this invention.

Circular end plate 241 of orbiting scroll member 24 can be cut away at its peripheral edge over an angular extent of 180° along the outermost curved surface of orbiting element 242, as shown in FIG. 5. End plate 241 is also cut away over the other angular extent of 180° along fixed spiral element 252 at a state where the terminal end of fixed spiral element 252 is in contact with orbiting spiral element 242. The cut away portions are shown as cross-hatched regions in FIG. 5.

Figure 6:
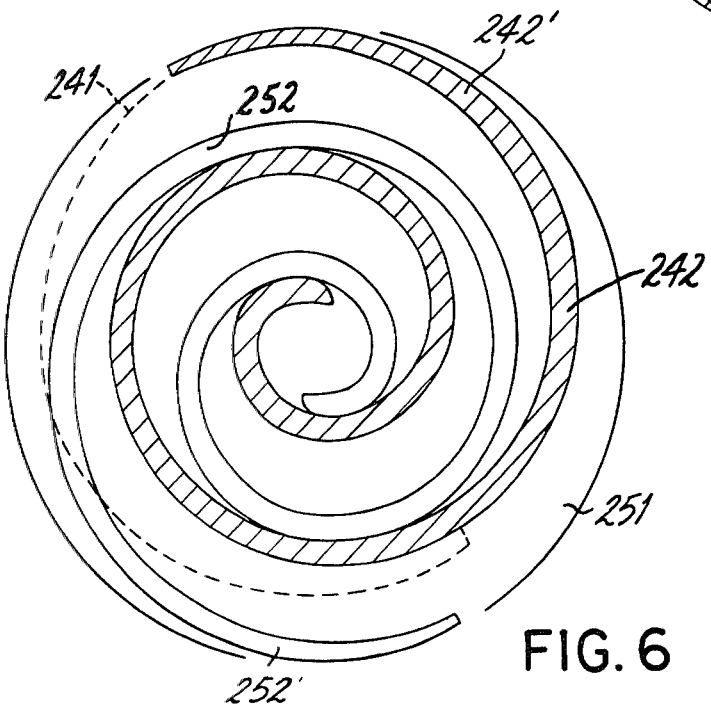
FIG. 6 is a schematic view of interfitting fixed and orbiting spiral elements according to a further embodiment of this invention.

Referring to FIG. 6, fixed and orbiting spiral elements 252 and 242 can terminate in gradually reduced area of sections 242' and 252'. That is, the increase in the radius of the sections is reduced. For example, the radius can be constant and, then, the outer curved surface of the section is an arcuate of a circle of radius a. Thus, the distance a from the center of each spiral element to its terminal end can be reduced. Therefore, the radius of the compressor housing may also be reduced. Furthermore, since each spiral element is tapered, the end portion has flexibility so that the mechanical shock by the collision of the terminal end of each spiral element with the other spiral element may be damped.

In the embodiment in FIG. 2, since the center axis of drive pin 23 coincides with the center of orbiting spiral element 242, the center axis of drive shaft 17 coincides with the center 0 of fixed spiral element 252 and, therefore, is offset from center axis 0 of the compressor housing by R/2. However, since all that is necessary for the complete operation of the device is that the central axes of drive pin 23 and drive shaft 17 coincide with two imaginary points due to the parallel movement of the centers 0' and 0 of interfitting orbiting and fixed spiral elements 242 and 252, drive shaft 17 may in an alternative embodiment be disposed so that the central axis thereof coincides with the central axis of the compressor housing.

This invention has been described in detail in connection with preferred embodiments, but these embodiments are for example only and this invention is not restricted thereto. It will be easily understood by those skilled in the art that the other variations and modifications to the embodiments shown can be easily made within the scope of this invention.

What is claimed is:

1. In a scroll-type fluid compressor unit comprising a cylindrical compressor housing having a front end plate and a rear end plate, a fixed scroll member fixedly disposed within said compressor housing and having first circular end plate means to which first wrap means is affixed, an orbiting scroll member orbitably disposed within said compressor housing and having second circular end plate means to which second wrap means is affixed, said second wrap means being similar to said first wrap means in number of turns, pitch and thickness, driving means for effecting orbital motion of said orbiting member, and said first and second wrap means interfitting with an angular phase difference of 180° to provide a plurality of line contacts to define at least one pair of sealed fluid pockets which move with a reduction of volume thereof by the orbital motion of said orbiting scroll member, to thereby compress the fluid in the pockets, the improvement comprising: said second circular end plate means having substantially a radius of $(2a-R)/2$, where a is a distance from the center of said second wrap means to its outer terminal end and R is the radius of said orbital motion, and the center of said second end plate means being offset from the center of said second wrap means toward the outer terminal end of said second wrap means by R/2, to thereby reduce the radius of said cylindrical compressor housing.

2. The improvement as claimed in claim 1, further comprising the center of said first wrap means of said fixed scroll member being offset from the center axis of said cylindrical compressor housing towards the outer terminal end of said first wrap means by R/2, whereby the radius of said cylindrical compressor housing may be reduced to $(2a+R)/2$ at a minimum.

3. The improvement as claimed in claim 1, further comprising: said second end plate means being cut away at the peripheral edge thereof over an angular extent of 180° along the outermost curved surface of said second wrap means, and said second end plate means being cut away at the peripheral edge thereof over the other 180° angular extent along the outermost curved surface of said first wrap means so that the outer contour of said second end plate means coincides with the outer contour of said interfitting first and second wrap means when the outer terminal end of each one of said wrap means contacts the other wrap means.

4. The improvement as claimed in claim 1, further comprising: each of said first and second wrap means terminating in a gradually reduced section, and the increase of the outer radius of said section is reduced in comparison with that of the inner radius thereof.

* * * * *